United States Patent [19]

Musschoot

[11] Patent Number: 5,067,549

[45] Date of Patent: Nov. 26, 1991

[54] COMPACTION APPARATUS AND PROCESS FOR COMPACTING SAND

[75] Inventor: Albert Musschoot, Barrington, Ill.

[73] Assignee: General Kinematics Corporation, Barrington, Ill.

[21] Appl. No.: 445,468

[22] Filed: Dec. 4, 1989

[51] Int. Cl.[5] ..... B22C 15/10

[52] U.S. Cl. ..... 164/39; 164/203; 366/114; 366/128

[58] Field of Search ..... 164/39, 34, 203; 366/110, 111, 112, 114, 128

[56] References Cited

U.S. PATENT DOCUMENTS

| | | | |
|---|---|---|---|
| 3,407,670 | 10/1968 | Venanzetti | 366/128 X |
| 4,389,120 | 6/1983 | Wadensten | 366/128 X |
| 4,454,906 | 6/1984 | Musschoot | 164/39 x |
| 4,766,771 | 8/1988 | Bailey et al. | 164/203 X |
| 4,784,206 | 11/1988 | Saverman et al. | 164/39 X |
| 4,796,685 | 1/1989 | Hanneton et al. | 164/203 |
| 4,805,421 | 7/1989 | Bailey et al. | 164/203 |
| 4,929,087 | 5/1990 | Brigolle | 164/203 X |

FOREIGN PATENT DOCUMENTS

| | | | |
|---|---|---|---|
| 54-35825 | 3/1979 | Japan | 164/203 |
| 63-260649 | 10/1988 | Japan | 164/34 |

*Primary Examiner*—J. Reed Batten, Jr.

*Attorney, Agent, or Firm*—Wood, Phillips, Mason, Recktenwald & Vansanten

[57] ABSTRACT

A flask adapted to contain a pattern and sand is resiliently supported in a controlled orientation and vibrational forces are imparted to the flask including a horizontal force component causing generally horizontal oscillating movement of the flask and alternative oppositely directed vertical force components maintaining the flask in a controlled orientation during the generally horizontal oscillating movement thereof. The vertical force components are adapted to counteract rotational inertia of the flask, pattern and sand.

27 Claims, 2 Drawing Sheets

COMPACTION APPARATUS AND PROCESS FOR COMPACTING SAND

BACKGROUND OF THE INVENTION

1. Field of the Invention

The present invention is generally related to compaction apparatus and processes and, more particularly, to a compaction apparatus and process for compacting sand in a flask about a pattern.

2. Background Art

There are many industrial applications utilizing granular materials, such as sand. One particularly noteworthy application is a foundry which performs the process of casting metals, e.g., by making sand molds for castings. In casting processes, a mold is made by packing molding sand around a pattern.

Because the sand must be tightly compacted around the pattern, sand migration must be facilitated. This is especially true in the case of complicated pattern configurations such as those that are available in modern casting processes. However, compaction systems have generally not provided the desired degree of sand migration or sand pressure.

The present invention is directed to overcoming the above stated problems and accomplishing the stated objects by providing a unique compaction apparatus and process for compacting sand.

SUMMARY OF THE INVENTION

Accordingly, the present invention is directed to a compaction apparatus comprising a flask adapted to contain sand. Means are provided for resiliently supporting the flask in a vertical orientation, as well as means for imparting vibrational forces to the flask. In particular, the vibrational forces have both horizontal force components and vertical force components.

Specifically, the horizontal force components cause generally horizontal oscillating movement of the flask. It is also a feature of the invention that the vertical force components are alternating oppositely directed forces which establish a force couple and maintain the flask in a controlled orientation during the generally horizontal oscillating movement thereof, particularly at the limits of travel where flask movement changes direction. In this connection, the force couple is adapted to counteract the rotational inertia of the sand-filled flask.

In an exemplary embodiment, the force imparting means includes a vibrator motor having a vibrator shaft and a plurality of additional vibrator shafts operatively associated with the vibrator motor shaft. The vibrator motor shaft and the additional vibrator shafts each include force producing and rotational inertia counteracting means associated therewith. Preferably, the vibrator motor with its vibrator shaft as well as the additional vibrator shafts are all rigidly mounted to a table which supports the flask in the vertical orientation.

In the preferred embodiment, the force producing and rotational inertia counteracting means includes an eccentrically mounted weight on the vibrator motor shaft and each of the additional vibrator shafts. The vibrator motor shaft and the additional vibrator shafts are all mounted on parallel axes extending generally perpendicular to the direction of generally horizontal oscillating movement of the flask. Also, two of the four parallel vibrator shafts are positioned and arranged so as to rotate in opposite directions about their respective parallel axes in a generally vertical plane in which the center of gravity of the flask, pattern and sand are disposed.

In this connection, the vertically coplanar vibrator shafts are preferably arranged such that their respective eccentrically mounted weights together produce a horizontal force component first in one direction and then in the opposite direction during one hundred eighty degrees of rotation thereof. Still more specifically, the vertically coplanar vibrator shafts are also preferably arranged such that their respective eccentrically mounted weights together produce equal but opposite vertical force components that cancel one another at every point throughout three hundred sixty degrees of rotation thereof.

With this arrangement, a pair of the vibrator shafts are also advantageously provided on opposite sides of one of the vibrator shafts in the generally vertical plane in which the center of gravity of the flask, pattern and sand are disposed. Advantageously, this pair of vibrator shafts is arranged such that the eccentrically mounted weights thereon each always produce equal but opposite vertical force components on opposite sides of the generally vertical plane first in one direction and then in the opposite direction during one hundred eighty degrees of rotation thereof. Preferably, the vertical force components establishing the force couple include a vertically downward force component on the leading edge of the flask and a vertically upward force component on the trailing edge of the flask.

In a modification to the exemplary embodiment, the vibrator motor may be mounted externally to the compaction apparatus and may drive the force imparting means comprising the four parallel shafts by means of a belt drive mechanism.

In addition, the present invention is directed to a process for compacting sand in a flask, including the step of resiliently supporting the flask in a vertical orientation. The process further includes the step of imparting vibrational forces to the flask having horizontal and vertical force components such that the horizontal force components cause generally horizontal oscillating movement of the flask and the vertical force components establish a force couple which comprises alternating oppositely directed force components for maintaining the flask in a controlled orientation during the generally horizontal oscillating movement thereof. In accordance with the process, the force couple is directed to counteract the rotational inertia of the flask, pattern and sand.

In another aspect of the present invention, the force couple established by the alternating oppositely directed vertical force components may be prescribed by means of the eccentric weights, specifically, the eccentric weights are such that the alternating oppositely directed vertical force components serve to maintain the flask in a vertical orientation during the generally horizontal oscillating movement thereof, particularly at the limits of travel where horizontal flask movement changes direction. In other words, the force couple produced by the eccentric weights is adapted to balance the rotational inertia of the sand-filled flask.

Other objects, advantages and features of the present invention will be apparent from a consideration of the following specification taken in conjunction with the accompanying drawings.

DETAILED DESCRIPTION OF THE PREFERRED EMBODIMENT

Figure 1:
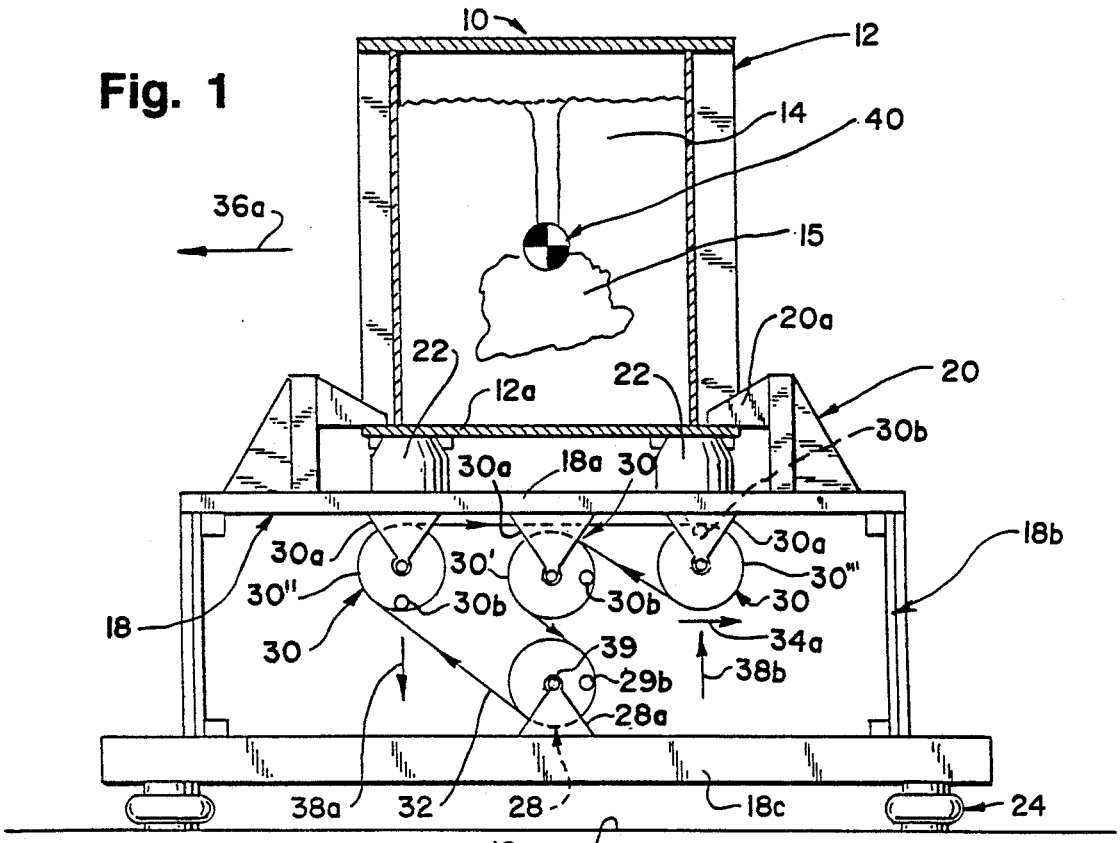
FIG. 1 is a front elevation view, partially schematic, illustrating the compacting apparatus of the present invention approaching the limit of travel in one direction.

Referring to the drawings, and first to FIG. 1, the reference numeral 10 designates generally a compaction apparatus in accordance with the present invention. The compaction apparatus 10 includes a flask 12 resiliently supported in a vertical orientation to contain sand 14 and a pattern 15.

Still referring to FIG. 1, a table 18 supports the flask 12 in the vertical orientation and conventional clamp means 20 releasably secures the flask 12 to the table 18. The clamp means 20 may be of a hydraulically actuated type commonly known to those skilled in the art. Clamp means 20 are distributed about the table 18 and include radially inwardly projecting fingers 20*a* adapted to engage a flange 12*a* of the flask 12.

In the preferred embodiment, the compaction apparatus 10 includes a plurality of resilient flask supports 22 which serve to resiliently support the flask 12 above the table 18. Thus, the inwardly projecting fingers 20*a* of the clamp means 20 engage the flange 12*a* to hold the flask 12 firmly in engagement with the resilient flask supports 22. In addition, the compaction apparatus 10 includes a plurality of resilient table supports 24 which serve to resiliently support the table 18 above a supporting surface 26.

As will be appreciated, the table 18 preferably includes a generally horizontal platform portion 18*a* to which the clamp means 20 and resilient flask supports 22 are secured. It will also be seen that the table 18 includes a plurality of resilient stabilizer members 18*b* depending therefrom and secured to a generally horizontal base 18*c* which is spaced from the platform portion 18*a* by means of the resilient stabilizer members 18*b* and spaced from the supporting surface 26 by means of the resilient table supports 24. With this arrangement, the resilient table supports 24 can take the form of airbags or springs secured to the underside of the base 18*c* to maintain it in spaced relation to the supporting surface 26.

As shown in FIG. 1, means are provided for imparting vibrational forces to the flask 12, including a vibrator motor 28 having a vibrator shaft 29 and a plurality of independent vibrator shafts 30. It will be appreciated that the independent vibrator shafts 30 are operatively associated with the shaft 29 of the vibrator motor 28 as through a timing belt 32, as will be discussed in greater detail hereinafter. While shown only schematically, it will be appreciated that the vibrator motor 28, with its shaft 29, is mounted on the base 18*c* by shaft supports 28*a* and vibrator shafts 30 are rigidly mounted to the platform portion 18*a* on shaft supports and 30*a* to impart vibrational forces from the shafts to the table 18.

Figure 3:
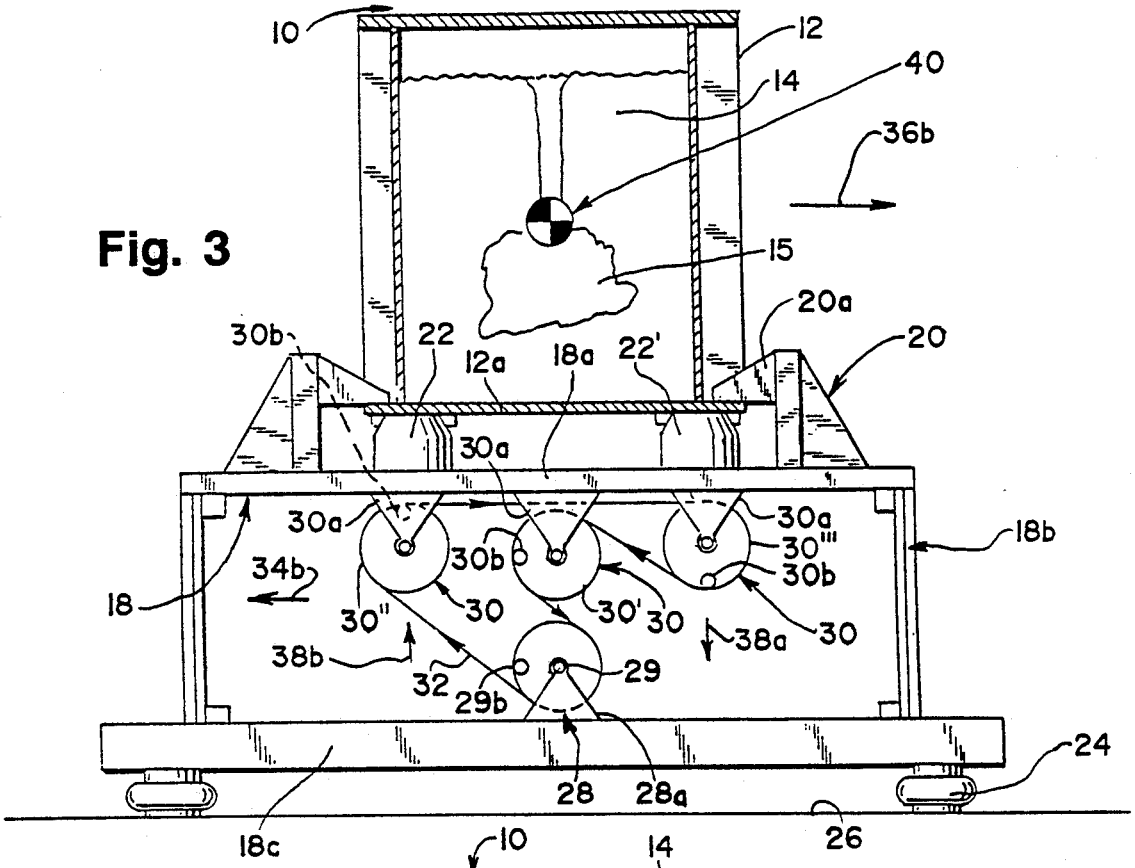
FIG. 3 is a front elevational view, partially schematic, illustrating the compacting apparatus of the present invention approaching the limit of travel in the opposite direction.

More specifically, the vibrator motor 28, with its shaft 29 and the other three vibrator shafts 30, imparts vibrational forces having horizontal force components, as represented by the arrows 34*a* (FIG. 1) and 34*b* (FIG. 3). This causes generally horizontal oscillating movement of the flask 12, as represented by the arrows 36*a* (FIG. 1) and 36*b* (FIG. 3). It will further be seen that the vibrational forces include alternating oppositely directed vertical force components, as represented by the arrows 38*a* and 38*b*. This establishes a force couple which maintains the flask 12 in a controlled orientation during the generally horizontal oscillating movement thereof. By means of the alternating oppositely directed vertical force components 38*a* and 38*b*, it is possible to counteract rotational inertia of the flask 12 in order to maintain its generally controlled orientation.

As will be appreciated by referring to FIGS. 1 and 3, the force couple comprises a vertically downward force component 38*a* acting on the leading edge of the flask 12 and a vertically upward force component 38*b* acting on the trailing edge of the flask 12 at least at the limits of travel during the generally horizontal oscillating movement of the flask 12. By now referring to FIGS. 2 and 4, it will be appreciated that the vertically downward force component 38*a* acting on the leading edge of the flask 12 and the vertically upward force component 38*b* acting on the trailing edge of the flask 12 are zero at the midway point between the limits of travel during the generally horizontal oscillating movement of the flask 12.

As shown in the drawings, the vibrator motor 28, with its vibrator shaft 29 and the other three independent vibrator shafts 30, each include force producing and rotational inertia balancing means associated therewith. More specifically, the force producing and rotational inertia balancing means includes eccentrically mounted weights 29*b* and 30*b*, respectively, on each of the vibrator motor shaft 29 and the independent vibrator shafts 30. With this arrangement, the vibrator motor shaft 29 and the vibrator shafts 30 are suitably mounted on parallel axes extending perpendicular to the direction of oscillating movement of the flask 12.

Still more specifically, the vibrator motor shaft 29 and one of the independent vibrator shafts 30′ are mounted so as to rotate in opposite directions about their respective parallel axes in a generally vertical plane in which the center of gravity, as at 40, of the flask 12, pattern 15 and sand 14 are disposed. The vertically coplanar vibrator motor 28 and vibrator shaft 30′ are also arranged, as will be appreciated by referring to FIGS. 1 and 3, such that their respective eccentrically mounted weights 29*b* and 30*b* together produce the horizontal force components 34*a* and 34*b* first in one direction and then in the opposite direction during a one hundred eighty degree rotation of the vibrator motor shaft 29 and the vibrator shaft 30′. As will also be appreciated, the vibrator motor shaft 29 and the vibrator shaft 30′ are arranged such that their respective eccentrically mounted weights 29*b* and 30*b* together produce equal but opposite vertical force components that cancel one another at every point during three hundred sixty degrees of rotation thereof.

By comparing FIGS. 1 through 4, it will be appreciated that a pair of the vibrator shafts 30″ and 30‴ are disposed at opposite sides of the vibrator shaft 30′. The timing belt 32, which may, by way of example, be a belt having double teeth along its length for nonslip drive, serves to join all of the vibrator shafts 30', 30'' and 30''' to the vibrator motor shaft 29 for driven movement thereby. By reason of the winding of the timing belt 32, the vibrator motor shaft 29 and vibrator shafts 30'' and 30''' rotate in the same direction about the parallel axes thereof.

By reason of the placement of the eccentrically mounted weights **30*b* on the vibrator shafts 30'' and 30''', the vertically downward force component 38*a* is applied first by the vibrator shaft 30'' and then by the vibrator shaft 30''' during a one hundred eighty degree rotation of the vibrator shafts 30'' and 30'''. Similarly, the vertically upward force component 38*b* is provided first by the vibrator shaft 30''' and then by the vibrator shaft 30'' during the same one hundred eight degree rotation of the vibrator shafts 30'' and 30'''. Thus, due to the relationship of the vibrator shafts 30'' and 30''', the vertical force components are always oppositely directed and cyclically alternating, i.e. alternate between a vertically downward force component 38*a* and a vertically upward force component 38*b*** during each one hundred eighty degree rotation.

Figure 2:
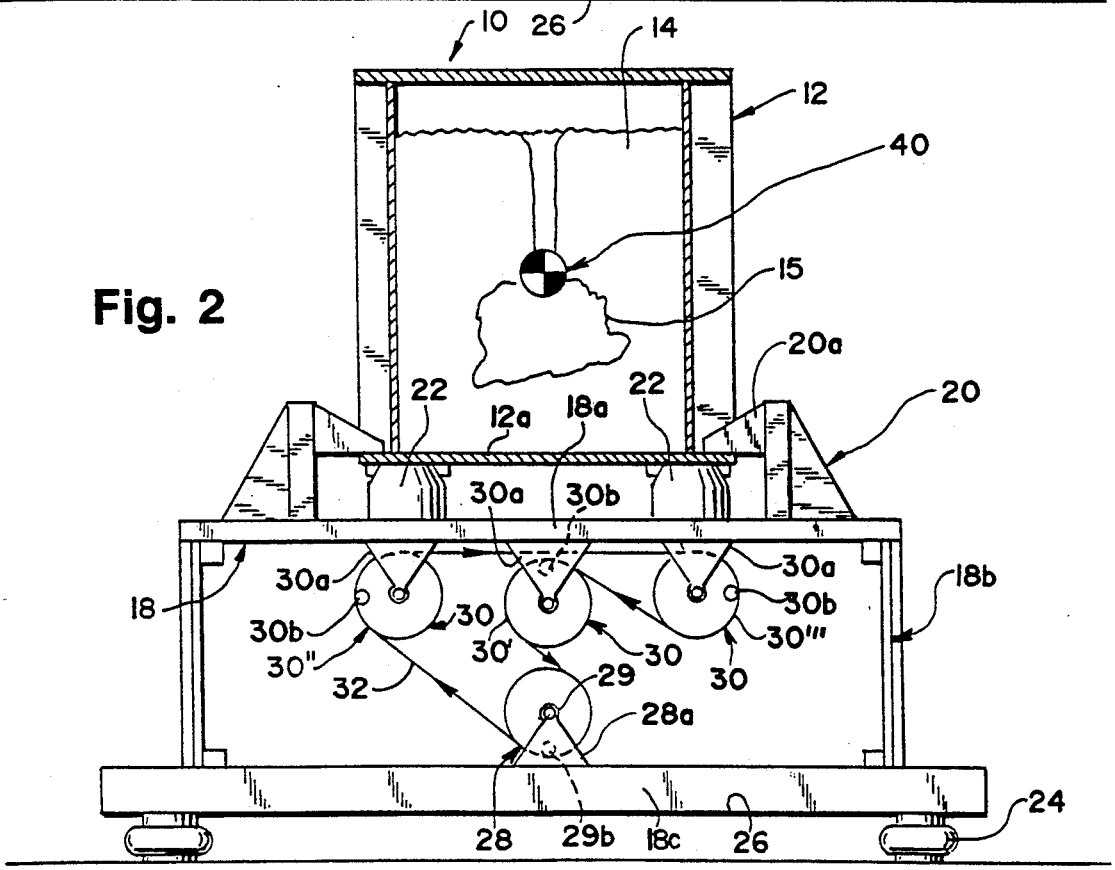
FIG. 2 is a front elevational view, partially schematic, illustrating the compacting apparatus at a first midstroke position.
Figure 4:
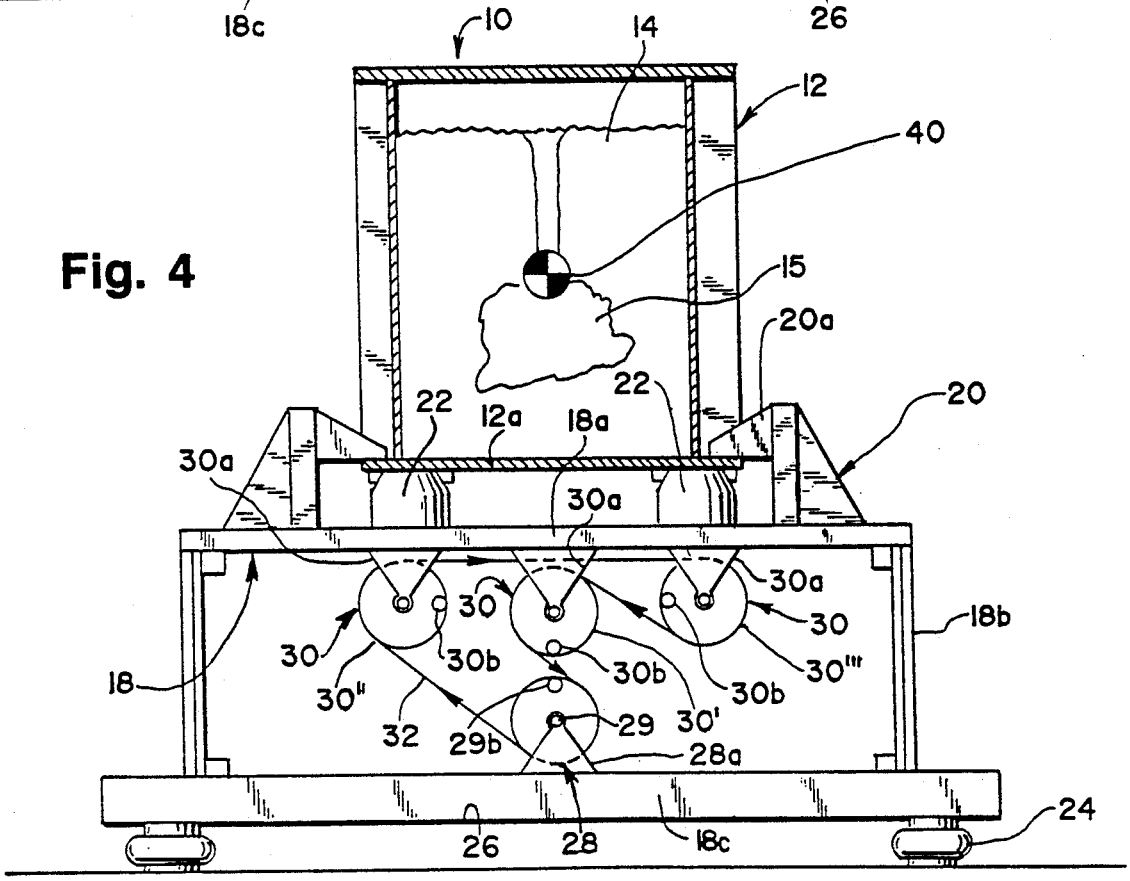
FIG. 4 is a front elevational view, partially schematic, illustrating the compacting apparatus at a second midstroke position.

As will be appreciated, the eccentrically mounted weights **30*b* on the vibrator shafts 30'' and 30''' produce no vertical force component at the midpoint of travel (see FIGS. 2 and 4). There is also no horizontal force component at this position by reason of the placement of the eccentrically mounted weights 29*b* and 30*b* on the vibrator motor shaft 29 and the vibrator shaft 30' inasmuch as these midstroke positions are where the compaction apparatus 10 is shifting from producing the horizontal force component 34*a* to cause generally horizontal oscillating movement first in one direction, as represented by the arrow 36*a*, to producing the horizontal force component 34*b* to cause generally oscillating movement next in the opposite direction, as represented by the arrow 36*b*. In addition, the position of the eccentrically mounted weights 29*b* on the vibrator motor shaft 29 and 30*b* on the vibrator shaft 30' cause the vertical force components to cancel at every position, including the midstroke positions, as shown in FIGS. 2 and 4**.

It should be understood that the vibrator motor 28 may be positioned such that the vibrator motor shaft 29 assumes the position of any of the four parallel vibrator shafts of the preferred embodiment. In a modification of the preferred embodiment, the motor may be mounted to the platform portion **18*a* on its shaft supports 28*a*, with a vibrator shaft such as 29 positioned as shown in the drawings and the independent vibrator shafts 30 and respective eccentric weights 29*b* and 30*b* also positioned as shown so as to achieve a force imparting means identical to that of the preferred embodiment. It should be further appreciated that the vibrator motor 28 could be mounted externally to the compaction apparatus 10 and connected through a belt drive such as 32 to any of a plurality of independent parallel vibrator shafts 29 and/or 30. Similarly, the vibrator motor 28 may be arbitrarily mounted to the platform portion 18*a* or base 18*c* on its shaft supports 28*a* and connected through a belt drive to any of a plurality of independent parallel vibrator shafts 29 and/or 30**.

In accordance with the invention, a process for compacting sand about a pattern in a flask has been provided which includes the step of resiliently supporting the flask in a vertical orientation The process further includes the step of imparting vibrational forces to the flask having both horizontal and vertical force components wherein the horizontal force components cause generally horizontal oscillating movement of the flask and the vertical force components comprise alternating oppositely directed vertical force components for maintaining the flask in a controlled orientation or orientations, during the generally horizontal oscillating movement thereof. With this unique arrangement of forces, and in accordance with the process, a force couple is directed so as to counteract the rotational inertia of the flask.

More specifically, the vibrational force imparting step produces the horizontal force components first in one direction and then in the opposite direction to cause the generally horizontal oscillating movement of the flask. The horizontal force components are produced in a generally vertical plane extending through the center of gravity of the flask and sand. Moreover, the vibrational force imparting step produces no resultant vertical force component in the generally vertical plane extending through the center of gravity of the flask, pattern and sand.

Additionally, the vibrational force imparting step produces a force couple comprising the alternating oppositely directed vertical components on opposite sides of the generally vertical plane extending through the center of gravity of the flask and sand. The force couple is produced first in one direction and then in the opposite direction in order to counteract the rotational inertia during the generally horizontal oscillating movement of the flask. In this connection, the vertical force components include a vertically downward force component on the leading edge of the flask and a vertically upward force component on the trailing edge of the flask at the limits of travel thereof.

With the compaction apparatus 10 illustrated in the drawings, the vibrator motor shaft 29 and vibrator shaft 30' produce the primary horizontal force. This, in turn, causes the flask 12 to undergo the generally horizontal oscillating movement which is well suited for compacting the sand 14 tightly around the pattern 15 within the flask 12. At the same time, the vibrator shafts 30'' and 30''' produce the vertical force components, i.e. countertorque forces, to counteract "tipping" forces from the rotational inertia of the flask 12.

As will be appreciated by referring to FIGS. 1 through 4, the eccentrically mounted weights **30*b* on the vibrator shafts 30'' and 30''' are always out of phase one hundred eighty degrees. Thus, when they are at their vertical extremes, as illustrated in FIGS. 1 and 3, they produce the vertical force components 38*a* and 38*b*, whereas, when they are at their horizontal extremes, they produce no vertical force components and cancel horizontal force components. As a practical matter, the vertical force components will increase from zero to a maximum as the eccentrically mounted weights 30*b*** move from their horizontal extremes to their vertical extremes.

With regard to the eccentrically mounted weights **29*b* and 30*b* on the vibrator motor shaft 29 and vibrator shaft 30', they produce the horizontal force components 34*a* and 34*b* at their horizontal extremes. As the eccentrically mounted weights move toward their vertical extremes, as illustrated in FIGS. 2 and 4, the horizontal force components change from a maximum value to zero. Also, because of the opposite rotation of the vibrator motor shaft 29 and the vibrator shaft 30', the eccentrically mounted weights 29***b* and 30*b* always produce vertical force components that cancel.

While in the foregoing there has been set forth a preferred embodiment of the invention, it will be appreciated that the details herein given may be varied by those skilled in the art without departing from the spirit and scope of the appended claims.

I claim:

1. A compaction apparatus, comprising:

a flask adapted to contain sand and a pattern;

means for resiliently supporting said flask in a controlled orientation; and means for imparting vibrational forces to said flask, said vibrational forces having horizontal force components causing generally horizontal oscillating movement of said flask and alternating oppositely directed vertical force components maintaining said flask in said controlled orientation during said generally horizontal oscillating movement thereof, said vertical force components establishing an alternating vertical force couple adapted to counteract rotational inertia of said flask.

2. The compaction apparatus as defined in claim 1 including a table supporting said flask in said controlled orientation, said table having clamp means associated therewith for releasably securing said flask thereto, said resilient supporting means being disposed between said table and a supporting surface so as to be in operatively associated relation thereto.

3. The compaction apparatus as defined in claim 1 including a table supporting said flask in said controlled orientation, said force imparting means including a vibrator motor having a shaft and a plurality of vibrator shafts operatively associated with said vibrator motor, said vibrator motor and said vibrator shafts being rigidly mounted to said table to impart said vibrational force thereto.

4. The compaction apparatus as defined in claim 1 including a table supporting said flask in said controlled orientation, said resilient supporting means including a plurality of resilient flask supports between said flask and said table, said resilient supporting means also including a plurality of resilient table supports between said table and a supporting surface, said resilient supporting means additionally including a plurality of resilient stabilizer members connecting adjacent stabilizers of said table.

5. The compaction apparatus as defined in claim 1 wherein said alternating vertical force couple comprises vertical force components which include a vertically downward force component acting on the leading edge of said flask and a vertically upward force component acting on the trailing edge of said flask at least at the limits of horizontal travel during said generally horizontal oscillating movement of said flask.

6. The compaction apparatus as defined in claim 5 wherein said vertically downward force component acting on the leading edge of said flask and said vertically upward force component acting on the trailing edge of said flask are zero at the midway point between the limits of horizontal travel of said flask during said generally horizontal oscillating movement thereof.

7. A compaction apparatus, comprising:

a flask adapted to contain sand and a pattern;

means for resiliently supporting said flask in a vertical orientation; and means for imparting vibrational forces to said flask, said vibrational forces having horizontal force components causing generally horizontal oscillating movement of said flask and alternating oppositely directed vertical force components maintaining said flask in said vertical orientation during said generally horizontal oscillating movement thereof, said vertical force components establishing an alternating vertical force couple adapted to balance rotational inertia at least at the limits of horizontal travel of said flask.

8. The compaction apparatus as defined in claim 7 including a table supporting said flask in said vertical orientation, said table having clamp means associated therewith for releasably securing said flask thereto, said resilient supporting means being disposed between said table and a supporting surface so as to be in operatively associated relation thereto.

9. The compaction apparatus as defined in claim 7 including a table supporting said flask in said vertical orientation, said force imparting means including a vibrator motor having a shaft and a plurality of vibrator shafts operatively associated with said vibrator motor, said vibrator motor and said vibrator shafts being rigidly mounted to said table to impart said vibrational force thereto.

10. The compaction apparatus as defined in claim 7 including a table supporting said flask in said vertical orientation, said resilient supporting means including a plurality of resilient flask supports between said flask and said table, said resilient supporting means also including a plurality of resilient table supports between said table and a supporting surface.

11. The compaction apparatus as defined in claim 7 wherein said said alternating vertical force couple includes a vertically downward force component acting on the lead edge of said flask and a vertically upward force component acting on the trailing edge of said flask at least at the limits of horizontal travel during said generally horizontal oscillating movement of said flask.

12. The compaction apparatus as defined in claim 11 wherein said vertically downward force component acting on the leading edge of said flask and said vertically upward force component acting on the trailing edge of said flask are zero at the midway point between the limits of horizontal travel of said flask during said generally horizontal oscillating movement thereof.

13. A compaction apparatus, comprising:

a flask adapted to contain a pattern and sand;

means for resiliently supporting said flask in a controlled orientation on a table; and means for imparting vibrational forces to said flask, said vibrational forces having horizontal force components causing generally horizontal oscillating movement of said flask and alternating oppositely directed vertical force components maintaining said flask in a controlled orientation during said generally horizontal oscillating movement thereof, said vertical force components establishing an alternating vertical force couple adapted to counteract rotational inertia of said flask, said force imparting means including a vibrational motor having a shaft and a plurality of independent vibrator shafts operatively associated with said vibrator motor, said vibrator motor shaft and said independent vibrator shafts each including force producing and rotational inertia counteracting means associated therewith, said vibrator motor and said independent vibrator shafts being rigidly mounted to said table to impart said vibrational force thereto.

14. The compaction apparatus as defined in claim 13 wherein said force producing and rotational inertia counteracting means includes an eccentrically mounted weight on each of said vibrator motor shaft and said independent vibrator shafts, said vibrator motor shaft and said independent vibrator shafts being mounted on parallel axes extending generally perpendicular to the direction of generally horizontal oscillating movement of said flask.

15. The compaction apparatus as defined in claim 14 wherein said vibrator motor shaft and one of said independent vibrator shafts are mounted in a generally vertical plane, the center of gravity of said flask, pattern and sand being disposed in said generally vertical plane, said vibrator motor shaft and said one of said independent vibrator shafts being adapted to rotate in opposite directions about said parallel axes thereof.

16. The compaction apparatus as defined in claim 15 wherein said vibrator motor shaft and said one of said independent vibrator shafts are arranged such that said eccentrically mounted weights thereon together produce a horizontal force component first in one direction and then in the opposite direction during a one hundred eighty degree rotation of said vibrator motor shaft and said one of said independent vibrator shafts.

17. The compaction apparatus as defined in claim 15 wherein said vibrator motor shaft and said one of said independent vibrator shafts are arranged such that said eccentrically mounted weights thereon together always produce equal but opposite vertical force components that cancel during a three hundred sixty degree rotation of said vibrator motor shaft and said one of said independent vibrator shafts.

18. The compaction apparatus as defined in claim 15 including a pair of said independent vibrator shafts on opposite sides of said one of said independent vibrator shafts, said vibrator motor shaft and said pair of independent vibrator shafts being adapted to rotate in the same direction about said parallel axes thereof, and including a timing belt joining all of said independent vibrator shafts to said vibrator motor shaft for driven movement thereby.

19. The compaction apparatus as defined in claim 18 wherein said pair of independent vibrator shafts are arranged such that said eccentrically mounted weights thereon together produce said vertical force components first in one direction and then in the opposite direction during a one hundred eighty degree rotation of said pair of independent vibrator shafts.

20. The compaction apparatus as defined in claim 19 wherein said alternating vertical force couple comprises vertical force components which include a vertically downward force component on the leading edge of said flask and a vertically upward force component on the trailing edge of said flask at the limits of horizontal travel during said generally horizontal oscillating movement of said flask.

21. A process for compacting sand around a pattern in a flask, comprising the steps of:

resiliently supporting said flask in a controlled orientation; and imparting vibrational forces to said flask having horizontal and vertical force components, said horizontal force components causing generally horizontal oscillating movement of said flask, said vertical force components comprising alternating oppositely directed vertical force components for maintaining said flask in said controlled orientation during said generally horizontal oscillating movement thereof, said vertical force components establishing an alternating vertical force couple adapted to counteract rotational inertia of said flask.

22. The sand compacting process as defined in claim 21 wherein said vibrational force imparting step produces said horizontal force components first in one direction and then in the opposite direction to cause said generally horizontal oscillating movement of said flask.

23. The sand compacting process as defined in claim 22 wherein said horizontal force components are produced first in one direction and then in the opposite direction in a generally vertical plane extending through the center of gravity of said flask, pattern and sand.

24. The sand compacting process as defined in claim 23 wherein said vibrational force imparting step produces no resultant vertical force component in said generally vertical plane extending through the center of gravity of said flask, pattern and sand.

25. The sand compacting process as defined in claim 21 wherein said vibrational force imparting step produces said alternating oppositely directed vertical force components on opposite sides of a generally vertical plane extending through the center of gravity of said flask, pattern and sand.

26. The sand compacting process as defined in claim 25 wherein said vertical force components are produced first in one direction and then in the opposite direction in order to counteract rotational inertia during said generally horizontal oscillating movement of said flask.

27. The sand compacting process as defined in claim 26 wherein said alternating vertical force couple comprises vertical force components which include a vertically downward force component on the leading edge of said flask and a vertically upward force component on the trailing edge of said flask at the limits of horizontal travel thereof.

* * * * *